US006523280B1

(12) United States Patent
Lapointe

(10) Patent No.: US 6,523,280 B1
(45) Date of Patent: Feb. 25, 2003

(54) BOUNCING DEVICE

(76) Inventor: Brian Keith Lapointe, 25 Cottage Dr., West Yarmouth, MA (US) 02673

( * ) Notice: Subject to any disclaimer, the term of this patent is extended or adjusted under 35 U.S.C. 154(b) by 0 days.

(21) Appl. No.: 09/683,800

(22) Filed: Feb. 15, 2002

(51) Int. Cl.[7] ..... A43B 3/10
(52) U.S. Cl. ..... 36/7.8; 36/132
(58) Field of Search ..... 36/7.8, 132, 27, 36/110

(56) References Cited

U.S. PATENT DOCUMENTS

| | | | | |
|---|---|---|---|---|
| 259,092 | A | * | 6/1882 | Butterfield |
| 1,516,395 | A | * | 11/1924 | Miceli |
| 2,756,517 | A | * | 7/1956 | Youtz |
| 4,457,084 | A | * | 7/1984 | Horibata et al. |
| 4,461,104 | A | * | 7/1984 | Calkin et al. |
| 4,619,059 | A | * | 10/1986 | Koniuk |
| 4,774,776 | A | * | 10/1988 | Gulli |

FOREIGN PATENT DOCUMENTS

| | | | |
|---|---|---|---|
| DE | 168966 | * | 5/1905 |
| DE | 365958 | * | 12/1922 |
| DE | 366344 | * | 1/1923 |
| DE | 465909 | * | 9/1928 |
| EP | 152969 | * | 8/1985 |
| GB | 4849 | * | of 1899 |

* cited by examiner

*Primary Examiner*—Ted Kavanaugh

(57) ABSTRACT

A lightweight bouncing sandal for youths, comprising a tough thin bottom layer, which is durable enough to withstand repeated scuffing and impacting with the ground and has an exposed textured surface to provide traction and reduced slipping when wet, a middle resilient layer of sufficient size and thickness to support a seventy-five pound load without compressing fully, a top confronting layer of semi-flexible material, with sufficient thickness and rigidity to support a two and one half pound per square inch load without distorting, with at least one elastic strap permanently affixed at its ends, such that it lays flat against the top layer without slack in a relaxed state, with an asymmetrically curved base to aid the user in maintaining balance while running, jumping or walking.

1 Claim, 3 Drawing Sheets

BOUNCING DEVICE

BACKGROUND OF INVENTION

1. Field of the Invention

This invention relates generally to bouncing devices and more particularly to an improved bouncing device, which is lightweight, simple and easy to use, with improved safety features and a versatile design, which provides an easy fit to a wide variety of foot sizes and footwear styles.

2. Prior Art

Various types of devices, such as pogo sticks or bouncing shoes, have been developed over the years to aid children in jumping or bouncing and therefore allow them to experience increased amusement at play. While such prior devices have provided children with the ability to jump or bounce higher and for longer intervals, the experience has not been without its shortcomings in the areas of safety, practicality, ease of use and affordability.

U.S. Pat. No. 1,545,437 discloses an exercising toy that is unstable and dangerous for children. Use of this device puts increased forces on the ankle joint. While walking or running, the base impacts the ground along a narrow section of the bottom edge and places the child in a dangerously unstable situation with each step.

Two, more stable designs for a bouncing devices, are disclosed in U.S. Pat. Nos. 2,756,517 and 4,676,009. While these devices do address the issues of stability, they are not adjustable enough to be able to accommodate a wide range of foot sizes or footwear styles. Both of these devices are considerably wider than the shoe of the user and so create a tripping hazard while walking or running.

In U.S. Pat. Nos. 4,774,776 and 5,423,136 Gulli discloses designs for two different bouncing attachments for shoes. The air inflated device of U.S. Pat. No. 4,774,776 poses the same tripping hazard previously mentioned and is prone to puncture from impacting a sharp object on the ground. The issue of comfort is of great concern with this design, since the force of jumping or running is concentrated beneath the arch of the foot. In normal running and jumping, the impact force on the foot is focused mainly beneath the front portion or "ball" of the foot allowing the arch to function as a shock absorber. The arch is not biomechanically well suited for accepting repeated direct impact, which results in a painful pulling apart of the arch itself. In his later approach, Gulli supports the entire foot beneath a flat resilient pad that incorporates pneumatic chambers. This design adds a considerable weight of molded rubber to each foot, which is undesirable for running or jumping. The large flat bottom does not allow the wearer to walk or run normally because initial contact with the ground is made along a ninety degree edge and creates the same instability as found with the device disclosed in U.S. Pat. No. 1,545,437.

U.S. Pat. Nos. 5,301,441 and 5,685,807 disclose similar jumping devices described as bouncing boots. Both of these devices correct some of the problems with earlier designs, such as adjustability and the potential for ankle injury, however these are large and complicated designs that would not be cost effective to manufacture. The large box required to merchandise these devices, would not meet current retail requirements of dollar-density to be granted shelf space and are therefore impractical solutions.

The need exists for an improved bouncing device, which is lightweight and cost efficient to manufacture. The need also exists for a bouncing device, which is simple to use and versatile enough to fit the variety of foot sizes found in children who enjoy jumping and bouncing, while addressing the safety issues of potential ankle injury, tripping and stability.

SUMMARY OF INVENTION

This invention is concerned with providing a lightweight bouncing device, which is lighter in weight, less costly to manufacture, easier and safer to use, and more versatile, automatically adjusting to the different foot or shoe sizes of children who are amused with the play of jumping, running and bouncing.

It is therefore one object of this invention, to provide a lightweight bouncing device, comprising a pair of slip-on sandals, with a semi-flexible planar top layer, a resilient middle layer of substantial thickness, and a flexible, thin, tough, bottom layer that is textured on its exposed surface for added traction.

It is a further object of this invention to address the issue of safety in bouncing devices, in a manner that is cost efficient and simple, by employing the use of two independent elastic straps to attach the bouncing device snugly to the foot during normal use, which allows the device to twist or rotate relative to the foot in the case of a loss of balance or impact with a surface or object that would otherwise cause the user to sustain an injury to the ankle.

It is another object of this invention to provide a bouncing device styled as a pair of slip-on sandals, comprised of very lightweight, resilient, foamed materials, resulting in a bouncing device which is much lighter in weight than prior designs, which is easier and less cumbersome for children to use, since the device, having very low inertia, requires little energy to accelerate and so stays in place and moves in unison with the foot.

It is a further object of this invention to provide a bouncing device styled as a pair of slip-on sandals, comfortable to use with shoes or bare feet, which allows the user to walk, run or jump while maintaining balance, by incorporating an asymmetrically curved bottom, which fully engages the calf muscle without sudden shock, so that the foot rolls gently into each step or vertical jump.

Other objects and advantages of this invention will become apparent from a consideration of the drawings and ensuing description.

DETAILED DESCRIPTION

Figure 1:
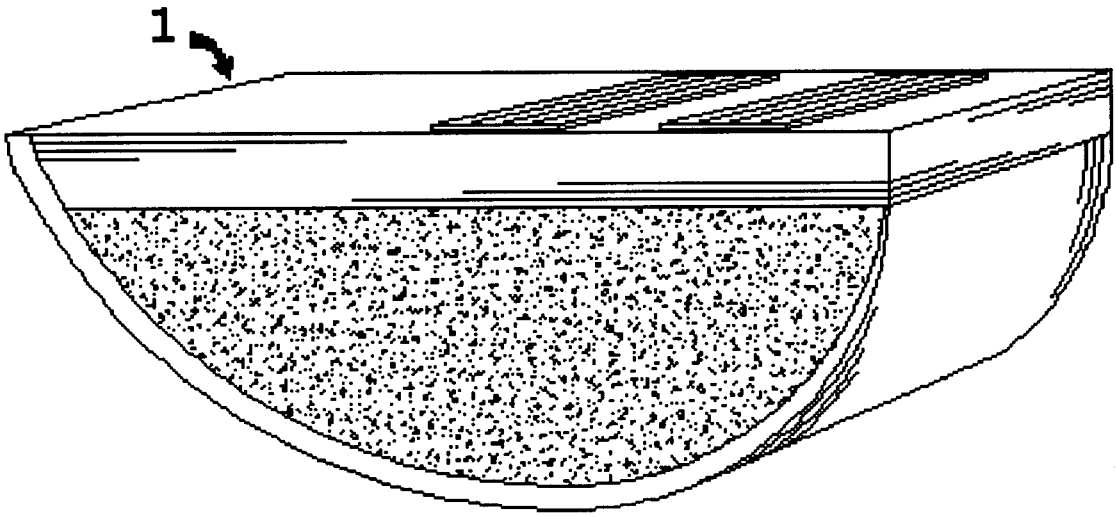
FIG. 1 is a perspective view of the preferred embodiment of the invention depicting the slip-on sandal styling.
Figure 2:
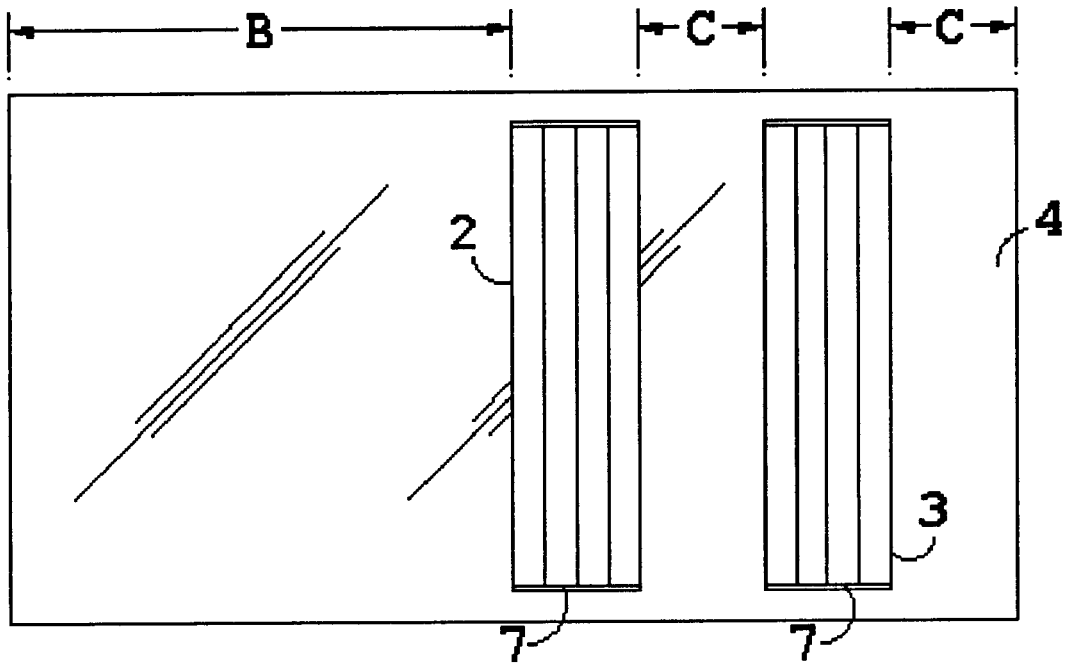
FIG. 2 is a top view of the preferred embodiment of the invention showing two independent elastic straps permanently attached and laying flat against the top surface.

In the preferred embodiment, FIG. 1 discloses an isometric view of a bouncing device 1, styled as a curved bottom slip-on sandal. As illustrated in FIG. 2, top layer 4 comprises a planar sheet of lightweight semi-flexible material such as closed cell foamed plastic, like polyethylene or ethylene vinyl acetate, of sufficient thickness and density to withstand a two and one half pound force per square inch without distorting, with two independent elastic straps 2 and 3, permanently affixed at their ends by passing the straps through slots 7 and gluing to the underside of top layer 4, (as is common practice in the shoe industry for securing sandal straps), such that straps 2 and 3 lay flat against layer 4 without slack when in a relaxed state. The location of straps 2 and 3 should be such, that both straps are within the front half of top layer 4 beginning at the midline, a distance B from the back edge with a space between straps 2 and 3 that is equal to the space in front of strap 3, so that distances C are equal.

Figure 3:
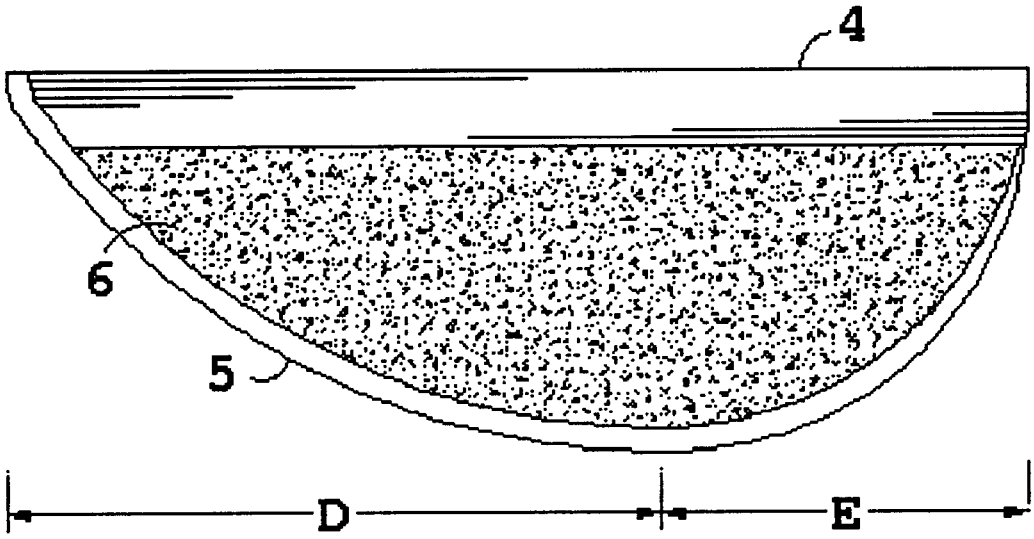
FIG. 3 is a side view of the preferred embodiment of the invention illustrating the three-layer construction and the shape of the asymmetrically curved bottom.

As illustrated in FIG. 3, a soft, resilient, middle layer material 6, such as low density, pure, ethylene vinyl acetate, should be of sufficient size and thickness to support the entire weight of the user without compressing fully. In the preferred embodiment, a target weight of seventy-five pounds is used to represent the heaviest child who would use this kind of device. A thin tough, bottom layer 5, is laminated to the entire curved underside of device 1, so that any part of device 1, which would contact the ground during use, is covered by durable layer 5. The overall curved bottom shape of device 1, as illustrated in FIG. 3, forces the user to walk on the front portion or "ball" of the foot, allowing the calf muscle a greater range of motion for jumping and maintaining forward and backward balance. In the preferred embodiment, the curved bottom of device 1 is such, that distance E is one half of distance D.

What is claimed is:

1. A slip-on sandal having a planar top surface and an asymmetrical bottom curved surface, said sandal comprising:

a semi-flexible top layer having said planar top surface, a middle layer having a lightweight, closed-cell foamed material having a substantial thickness with a curved asymmetrical bottom surface and a planar top surface, wherein said middle layer is compressible to permit a user to bounce and is shaped so that a thickest part is positioned in a front half of said sandal corresponding to a position beneath a ball of the foot of the user, a flexible, thin bottom layer having said asymmetrical bottom curved surface corresponding to said asymmetrical bottom surface of said middle layer, wherein said asymmetrical bottom curved surface of said bottom layer aids the user in maintaining balance while running, jumping and walking, and a pair of independent elastic straps located in said top layer in said front half of said sandal, wherein said elastic straps lay flat against said top surface of said top layer, without slack, when in a relaxed state, wherein said straps hold the users foot on said top surface of said top layer.

* * * * *